United States Patent [19]

Fujishiro

[11] 4,273,320

[45] Jun. 16, 1981

[54] FOLDING MECHANISM FOR A PRINTING PRESS

[75] Inventor: Yuji Fujishiro, Tokyo, Japan

[73] Assignee: Kabushiki Kaisha Tokyo Kikai Seisakusho, Tokyo, Japan

[21] Appl. No.: 916,749

[22] Filed: Jun. 19, 1978

[30] Foreign Application Priority Data

Feb. 27, 1978 [JP] Japan ..... 53-23434[U]

[51] Int. Cl.[3] ..... B65H 45/16

[52] U.S. Cl. ..... 493/427; 493/431

[58] Field of Search ..... 270/76–77

[56] References Cited

U.S. PATENT DOCUMENTS

| | | | |
|---|---|---|---|
| 3,038,719 | 6/1962 | Tyma | 270/77 |
| 3,517,920 | 6/1970 | Snyder | 270/77 |
| 3,865,361 | 2/1975 | Neal | 270/76 |

FOREIGN PATENT DOCUMENTS

| | | | |
|---|---|---|---|
| 2652159 | 5/1978 | Fed. Rep. of Germany | 270/77 |

*Primary Examiner*—Edgar S. Burr
*Assistant Examiner*—A. Heinz
*Attorney, Agent, or Firm*—Wegner & Bretschneider

[57] ABSTRACT

A folding mechanism for a printing press comprising a frame of the printing press, a folding cylinder rotatably mounted on said frame, an eccentric member fixedly secured to said frame, said eccentric member having first and second holes formed therein, a sun gear shaft inserted in the first hole of said eccentric member and fixedly secured thereto, said sun gear shaft having a sun gear formed at one end thereof, a gear box rotatably mounted on said sun gear shaft, and a drive shaft rotatably mounted on said frame at one end thereof, the other end of said drive shaft being fixedly secured to said gear box and adapted to rotate together. The improved folding mechanism further comprising a pair of idler gears rotatably mounted in said gear box adapted in mesh with said sun gear, a pair of folding blade shafts rotatably mounted on said gear box, each of said folding blade shafts having a plurality of folding blades and a driving gear mounted thereon, said driving gears being adapted to mesh with said idler gears and one of said driving gears being adapted to move in axial direction out of engagement of said idler gear, a manually-operated mechanism for interrupting the drive to one of said folding blade shafts for silencing the folding blades associated therewith, and a segment gear fixedly mounted on said gear box for locking said one of folding blade shafts against rotation when said one of driving gears is moved in axial direction out of engagement of one of said idler gears to engage with said segment gear.

3 Claims, 15 Drawing Figures

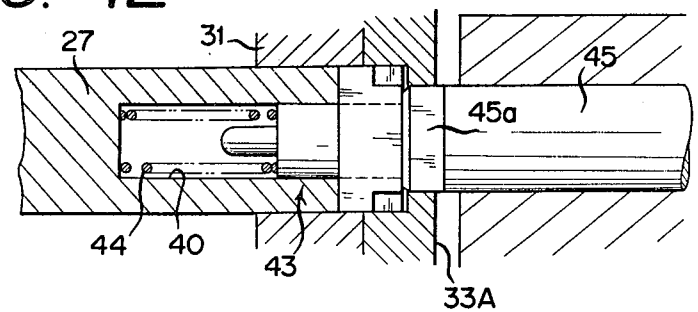
FIG. 12
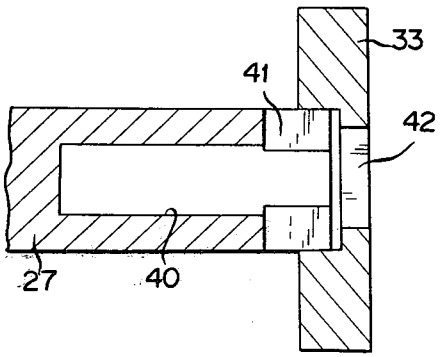
FIG. 13
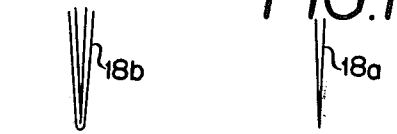
FIG. 14-I
FIG. 14-II

FOLDING MECHANISM FOR A PRINTING PRESS

BACKGROUND OF THE INVENTION

This invention relates to a folding mechanism for a printing press which may readily be converted from a straight folding operation to a collect folding operation and vice versa.

One of the problems existing in conventional newspaper folding mechanisms is to provide a folding cylinder which may be readily changed from a straight operation to a collect operation and vice versa where mechanism will be sturdy, compact and provide for positive and accurate engagement and disengagement of folding blade shafts with drive means for rotating the shafts so that the blades may be periodically moved outwardly of the cylinder to move sections of the paper into the nip between folding rolls.

The cylinder itself is of relatively heavy construction in order to withstand the rigors of high speed usage such that any mechanisms for silencing operation of a particular series of folding blades must in itself be sturdy and compact.

SUMMARY OF THE INVENTION

It is therefore an object of the present invention to provide a folding mechanism for a printing press which is capable of both straight and collect operations and which includes an improved means for converting from one type of operation to the other.

Another object of the present invention is to provide a folding mechanism having converting means which is readily accessible for convenient use by the press operator, and which is positive and safe.

A further object of the present invention is to provide a folding mechanism which is adapted to two types of operation and which includes a novel arrangement for silencing the unused folding blade and for locking the same into a safe position incident to disconnecting the drive therefrom.

In accordance with an aspect of the present invention there is provided a folding mechanism for a printing press comprising a frame of the printing press, a folding cylinder rotatably mounted on said frame, an eccentric member fixedly secured to said frame, said eccentric member having first and second holes formed therein, a sun gear shaft inserted in the first hole of said eccentric member and fixedly secured thereto, said sun gear shaft having a sun gear formed at one end thereof, a gear box rotatably mounted on said sun gear shaft, and a drive shaft rotatably mounted on said frame at one end thereof, the other end of said drive shaft being fixedly secured to said gear box and adapted to rotate together. The improved folding mechanism further comprising a pair of idler gears rotatably mounted in said gear box adapted in mesh with said sun gear, a pair of folding blade shafts rotatably mounted on said gear box, each of said folding blade shafts having a plurality of folding blades and a driving gear mounted thereon, said driving gears being adapted to mesh with said idler gears and one of said driving gears being adapted to move in axial direction out of engagement of said idler gear, manually-operated means for interrupting the drive to one of said folding blade shafts for silencing the folding blades associated therewith, and interlock means fixedly mounted on said gear box for locking said one of folding blade shafts against rotation when said one of driving gears is moved in axial direction out of engagement of one of said idler gears to engage with said interlock means.

The above and other objects, features and advantages of the present invention will be readily apparent from the following description taken in conjunction with the accompanying drawings.

BRIEF DESCRIPTION OF THE DRAWINGS

FIG. 12 is a view showing the engagement of the operating rod with the manipulating disc;

FIG. 13 is a cross-sectional view of one end of the folding blade shaft showing a construction of engaging holes formed in the folding blade shaft and the manipulating disc;

FIG. 14-I is an explanational view of a paper folded by straight run; and

FIG. 14-II is similar to FIG. 14-I but showing papers folded by correct run.

DETAILED DESCRIPTION OF THE INVENTION

Figure 1:
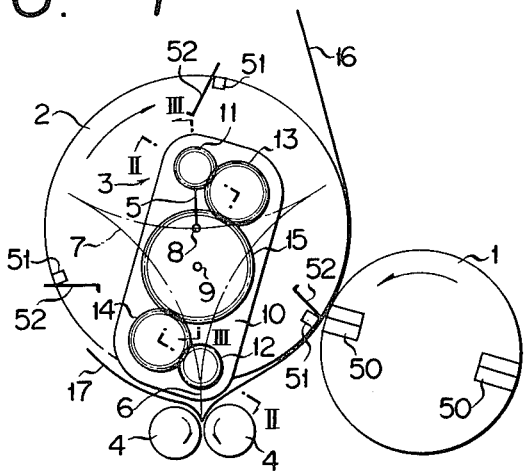
FIG. 1 is a schematic front elevation of a folding and cutting mechanism of a printing press incorporating the present invention.

The present invention will now be described below by way of example only with reference to the accompanying drawings. Reference numeral 19 denotes a frame of a folding machine which holds a folding cylinder 2 through a bearing 39.

Fixedly secured to the folding machine frame is an outer end of an eccentric member 20 which is adapted to be inserted into the folding cylinder 2. The eccentric member 20 has a hole 60 formed therein in which a manipulating tool 37 is inserted. A shaft portion **15*a* of a sun gear 15 is fixedly secured to the eccentric member 20 by means of a nut 21 at a location offset from the centre of the eccentric member 20**.

A gear box 10 is mounted on the shaft portion **15*a* through bearings 25 and 26, and the aforementioned sun gear 15 is located within and at the centre of the gear box 10**.

Carried through a bearing 24 by the central portion of the sun gear 15 is a driving shaft 23 which is fixedly secured to the gear box 10. A folding blade shaft 27 is rotatably mounted on one side of the gear box 10, and another folding blade shaft 28 on the other side thereof.

Further, rotatably mounted in the gear box 10 are idle gears 13 and 14 which mesh with the above-mentioned sun gear 15. The idle gear 13 is engaged with a shaft gear or driving gear 11 fixedly secured to the folding blade shaft 27, while the idle gear 14 meshes with a shaft gear or driving gear 12 fixedly secured to the folding blade shaft 28.

The folding blade shaft 27 is supported through a bearing 27*a* by the gear box 10, and the end of the shaft 27 is held by a manipulating ring 31 which is mounted through a bearing 32 on the gear box 10.

Fixedly secured to the end face of the manipulating ring 31 is a manipulating disk 33.

The above-mentioned folding blade shaft 27 has at the end thereof an insertion hole 40 formed therein and having its bottom in the axial direction, and also has an engaging groove 41 formed in the end face thereof.

The above-mentioned manipulating disk 33 has an engaging hole 42 formed therein opposite to the engaging groove 41. The engaging hole 42 comprises an outer engaging hole portion 42*a* having the rectangular configuration similar to the engaging groove 41. The inner engaging groove 41 is longer than the outer engaging hole portion 42*a*. Reference numeral 43 denotes an engaging member which comprises a cylindrical portion 43*a* and prismatic portions 43*b* and 43*c*. The engaging member 43 is resiliently biased by a spring 44 so that the prismatic portion 43*b* is engaged with the engaging groove 41 of the folding blade shaft 27 and the prismatic portion 43*c* is engaged with the engaging hole portion 42*a* of the manipulating disk 33 thereby locking the folding blade shaft 27 to the manipulating disk 33. When the engaging member 43 is forced into the insertion hole 40 against the resilient force of the spring 44, the prismatic portion 43*c* is disengaged from the engaging hole portion 42*a* and is fitted into the engaging groove 41 instead.

The above-mentioned manipulating ring 31 has a screw-threaded portion 31*b* formed inside thereof.

Connected by splines to the folding blade shaft 27 is the driving gear 11 which has a screw-threaded portion 11*a* formed on the terminal end portion thereof, the screw-threaded portion 11*a* being threadably engaged with the screw-threaded portion 31*b*.

Both the driving gear 11 and the idle gear 31 are formed in a plurality of axially spaced sections having relieved portions therebetween so that they can be engaged and disengaged to each other.

Fixedly secured to the end of the gear box 10 is a segment gear 29 serving as a meshing member adapted to mesh with the driving gear 11.

Figure 10:
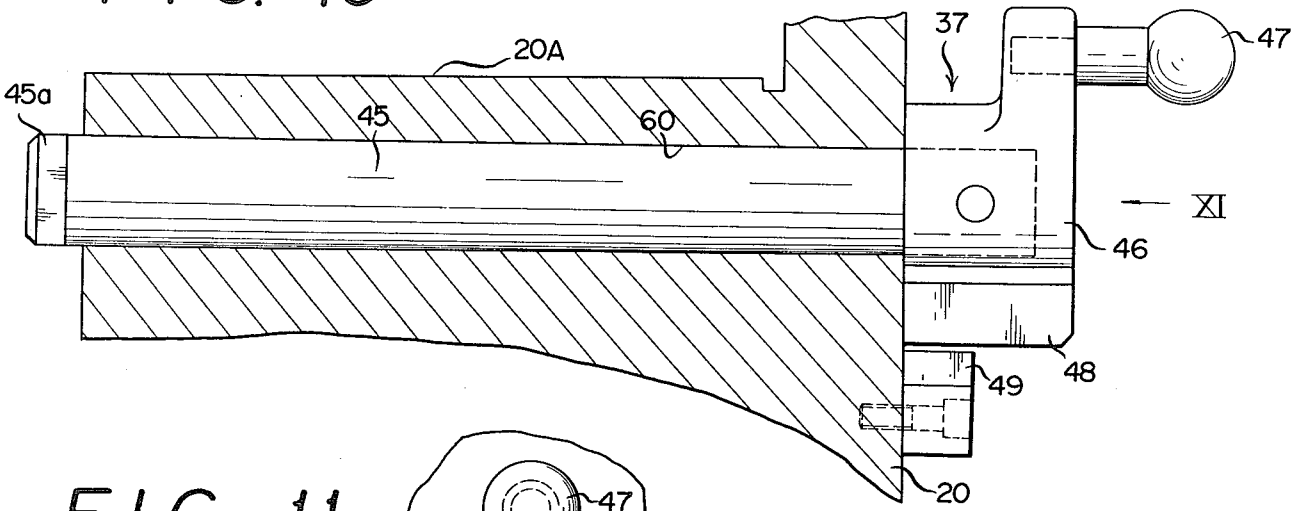
FIG. 10 is a cross-sectional view of part of the eccentric member wherein the operating rod is inserted therethrough.
Figure 11:
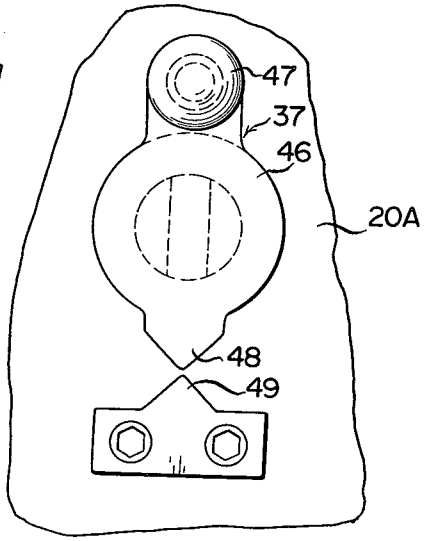
FIG. 11 is a view as seen from an arrow XI in FIG. 10.

As shown in FIGS. 10 and 11, a manipulating tool 37 has a rod 45 adapted to be inserted into the hole 60, and the rod 45 has at the leading end thereof a protuberance 45*a* adapted to engage with and disengage from the engaging hole portion 42*a* of the manipulating disk 33.

Further, the rod 45 has a lever 46 fixedly secured to the trailing end thereof. The lever 46 has a handle 47 attached to one end thereof, and the other end of the lever 46 is shaped in the form of a reference blade 48.

Reference numeral 49 denotes a reference member fixedly secured to the eccentric member 20; 1 a cutter cylinder circumscribing the folding cylinder 2, 50 two sets of cutter blades mounted on the cutter cylinder 1, 51 rubber rests for cutter blades, and 52 three sets of pins mounted on the folding cylinder 2.

The operation of the device of the present invention will now be described below.

A sheet of paper 16 continuously run and introduced into the folding machine is pulled by the action of one set of pin among the three sets of pins 52 mounted on the folding cylinder 2 so as to move forward along the cylinder. When the paper 16 has advanced over a predetermined distance, it is cut by one set of the cutter blades 50, and then inserted between folding rolls 4, 4 by the action of folding or tucker blades 6 so as to be folded double, and subsequently discharged downwards in the form of a sheet of folded paper 18*a*.

The outer circumferential length of the cutter cylinder 1 is predetermined to be twice the length of the paper to be cut, whilst that of the folding cylinder 2 is three times the length of the paper to be cut. The ratio of rotation of the cutter blade 1 to the folding cylinder 2 is 3:2, and that of the cutter blade 1 to a spider 3 is 1:1. Therefore, the ratio of rotation of the folding cylinder 2 to the spider 3 becomes 2:3.

The leading end of folding blades 5 and 6 fitted to the folding blade shafts 27 and 28 produce locus of motion indicated by reference numeral 7.

In case of effecting "straight run", two sets of folding blades 5 and 6 are used so that three sets of folded papers 18*a* can be produced every one rotation of the folding cylinder 2. The second condition of operation is that for a "collect run". In the operation of the folder during a correct run two different sections of the product must be brought together, i.e., collected, before the product receives its final hold. During collect operation one folding blade is silenced, and the timing of the projection and withdrawal of the sets of pins 52 is adjusted so that each sets of pins is withdrawn once every two revolutions of the holding cylinder 2.

Therefore, three sets of folded papers or product 18*b* as shown in FIG. 14II can be produced every two revolutions of the folding cylinder 2. More detailed explanation for collect operation can be found in U.S. Pat. No. 3,038,719 to L. S. Tyma, Jr.

As hereinbefore mentioned in the collect run, it is necessary to silence either one of the folding blades 5 and 6 mounted on the spider 3. Since the suspended folding blade 5 is not allowed to project from the outer circumference of the folding cylinder 2 when the folding machine is rendered operative, it is most desirable to locate the folding blade 5 taking a rest at the position shown in FIG. 1.

Figure 4:
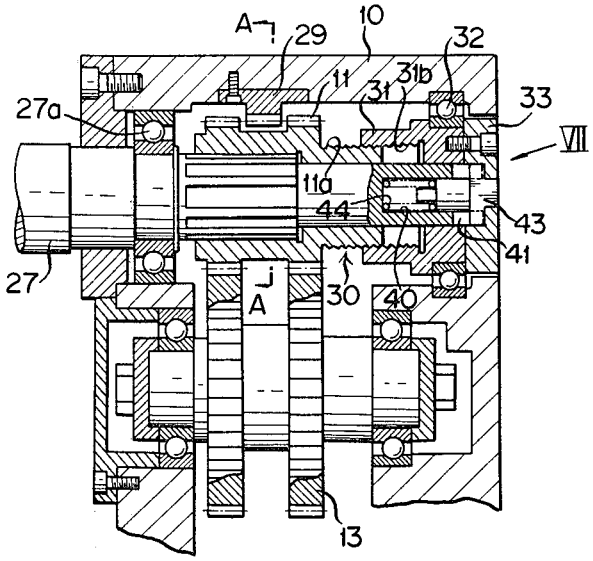
FIG. 4 is an enlarged representation of a primary construction of the present invention showing straight operation.

When the "straight run" is carried out, as shown in FIG. 4, the idle gear 13 is engaged with the driving gear 11, and the driving gear 11 is disengaged from the segment gear 29.

Therefore, the gear box 10 is rotated by the rotation of a driving shaft 23, and the idle gear 13 turning on its axis and around the sun gear 15 will rotate the folding blade shaft 27 through the driving gear 11, whilst in the similar manner, the idle gear 14 will rotate the folding blade shaft 28 through the driving gear 12.

Figure 5:
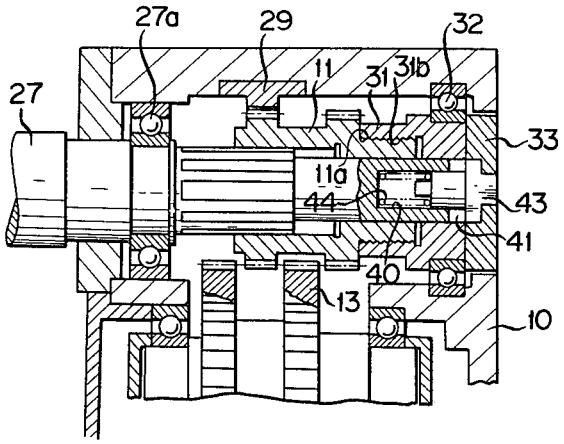
FIG. 5 is similar to FIG. 4 but showing correct operation.
Figure 6:
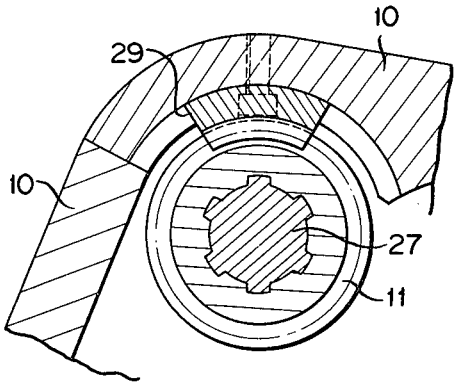
FIG. 6 is a cross-sectional view taken along the line A—A in FIG. 4.
Figure 7:
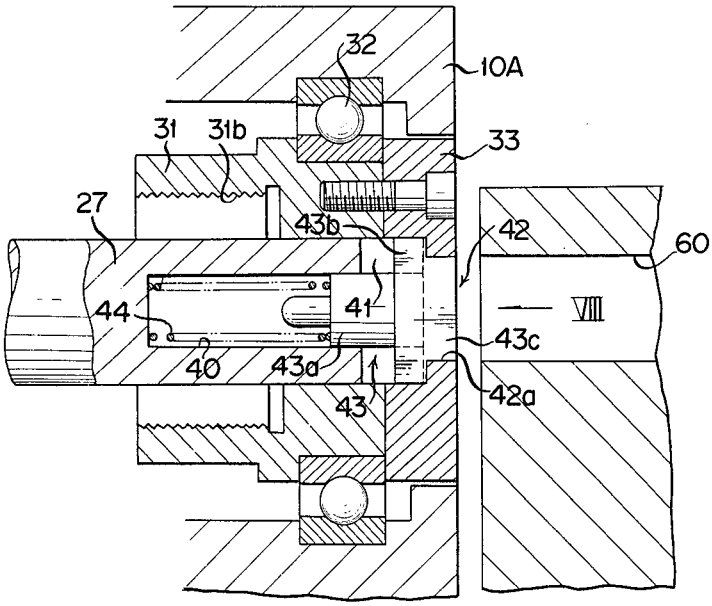
FIG. 7 is an enlarged explanational view of portion VII in FIg. 4.
Figure 8:
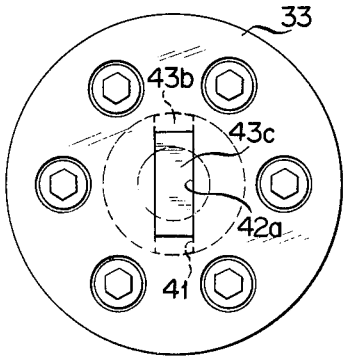
FIG. 8 is a view as seen from an arrow VIII in FIG. 7.
Figure 9:
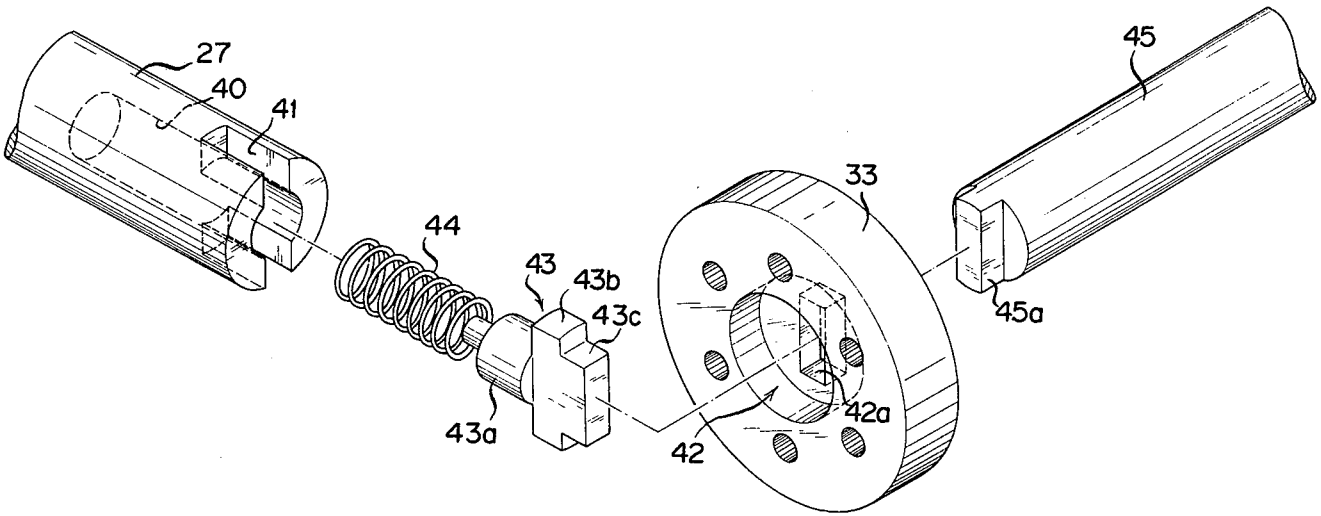
FIG. 9 is a perspective explosion of a manually-operating means mounted on one end of the folding blade shaft.

When it is desired to make "correct run", the drive gear 11 is disengaged from the idle gear 13 and is engaged with the segment gear 29 as shown in FIG. 5.

Figure 2:
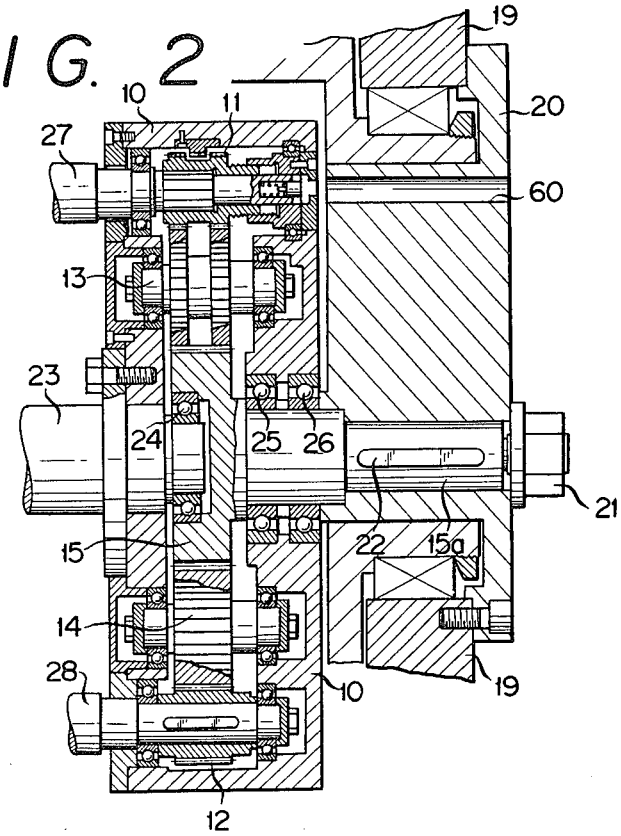
FIG. 2 is a cross-sectional view taken along the line II—II in FIG. 1.
Figure 3:
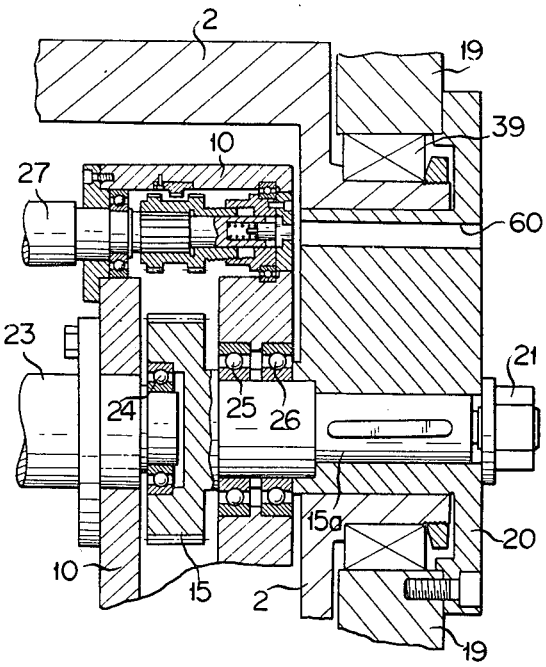
FIG. 3 is a cross-sectional view taken along the line III—III in FIG. 1.

This can be accomplished by inserting the rod 45 of the manipulating tool 37 into the hole 60 formed in the eccentric member 20 as shown in FIG. 2, engaging the protuberance or projection 45*a* formed at the leading end of the rod 45 with the engaging hole portion 42*a* of the manipulating disk 33, moving the engaging member 43 against the biasing force of the spring 44 so as to disengage the folding blade shaft 27 from the manipulating disk 33, turning the manipulating tool 37 so as to threadably move the screw-threaded portion 11*a* of the driving gear 11 engaged with the screw-threaded portion 31*b* of the manipulating ring 31 thereby slidably moving the driving gear 11 in the axial direction.

Since it is required to effect engagement and disengagement of the driving gear 11 with and from the idle gear at the predetermined location wherein the folding blade 5 assumes such position as shown in FIG 1, the folding machine is stopped at this position and then change-over operation is effected.

Upon insertion of the manipulating tool 37 into the hole 60, the engaging projection 45*a* can be easily engaged with the engaging hole portion 42*a* by registering the reference blade 48 with the reference member 49.

It is needless to say that the manipulating tool 37 must be withdrawn from the hole 60 during machine operation.

Since the present invention is constructed as mentioned in detail hereinabove, when it is desired to effect the changeover from "straight run" to "correct run", the rod 45 of the manipulating tool 37 is inserted into the hole 60 of the eccentric member 20 and the engaging protuberance 45*a* formed at the leading end of the rod 45 is inserted into the engaging hole 42*a* of the manipulating disk 33 thereby disengaging the prismatic portion 43*c* of the engaging member 43 from the engaging hole portion 42*a*. By the above-mentioned operation, the folding blade shaft 27 can be unlocked from the manipulating disk 33. Thus, by turning the manipulating tool 37 clockwise, the manipulating disk 33 and the manipulating ring 31 are permitted to turn clockwise with the folding blade shaft 27 remaining stationary, and because the driving gear 11 is threadably engaged with the manipulating ring 31, the driving gear 11 is moved to the right in the drawing. Consequently, the driving gear 11 is disengaged from the idle gear 13 and is engaged with the segment gear 29 so that the folding blade shaft 27 can be locked relative to the gear box 10. Therefore, the folding blade 5 mounted on the folding blade shaft 27 occupies the position shown in FIG. 1 so as to enable "correct run" to be effected.

On the contrary, when it is desired to effect change-over from "correct run" to "straight run", it is necessary to turn the manipulating tool 37 counterclockwise so as to move the driving gear 11 to the left in the drawing thereby disengaging the driving gear 11 from the segment gear 29 and engaging the driving gear 11 with the idle gear 13.

Therefore, according to the present invention, the change-over from "straight run" to "correct run" can be readily effected by a simple operation and vice versa.

While the invention has been described and shown with particular reference to the preferred embodiment, it will be apparent that variations and modifications might be possible that would fall within the scope of the present invention, which is not intended to be limited except as defined in the following claims.

What is claimed is:

1. In a folding mechanism for a printing press including a frame of the printing press, a folding cylinder rotatably mounted on said frame, an eccentric member fixedly secured to said frame, said eccentric member having first and second holes formed therein, a sun gear shaft inserted in the first hole of said eccentric member and fixedly secured thereto, said sun gear shaft having a sun gear formed at one end thereof, a gear box rotatably mounted on said sun gear shaft, and a drive shaft rotatably mounted on said frame at one end thereof, the other end of said drive shaft being fixedly secured to said gear box and adapted to rotate together; the improvement comprising a pair of idler gears rotatably mounted in said gear box adapted in mesh with said sun gear, a pair of folding blade shafts rotatably mounted on said gear box, each of said folding blade shafts having a plurality of folding blades and a driving gear mounted thereon, said driving gears being adapted to mesh with said idler gears and one of said driving gears being adapted to move in axial direction out of engagement of said idler gear, manually-operated means for interrupting the drive to one of said folding blade shafts for silencing the folding blades associated therewith comprising a manipulating ring rotatably mounted on said gear box, one end of said one of the folding blade shafts being inserted into said manipulating ring and having an axial hole formed therein, a manipulating disc fixedly secured to said manipulating ring, said manipulating disc having a hole formed therein, an engaging member disposed in the hole of said manipulating disc for selectively engaging or disengaging said one of the folding blade shafts with or from said manipulating disc, and spring means disposed in the axial hole of said one of the folding blade shafts for urging said engaging member toward said manipulating disc so as to engage said folding blade shaft with said manipulating disc, and interlock means fixedly mounted on said gear box for locking said one of folding blade shafts against rotation when said one of driving gears is moved in axial direction out of engagement of one of said idler gears to engage with said interlock means.

2. The folding mechanism for printing press as defined in claim 1 wherein one of the driving gears and one of the idler gears are formed in a plurality of axially spaced sections having relieved portions therebetween so that they can be engaged and disengaged to each other.

3. In a folding mechanism for a printing press including a frame of the printing press, a folding cylinder rotatably mounted on said frame, an eccentric member fixedly secured to said frame, said eccentric member having first and second holes formed therein, a sun gear shaft inserted in the first hole of said eccentric member and fixedly secured thereto, said sun gear shaft having a sun gear formed at one end thereof, a gear box rotatably mounted on said sun gear shaft, and a drive shaft rotatably mounted on said frame at one end thereof, the other end of said drive shaft being fixedly secured to said gear box and adapted to rotate together; the improvement comprising a pair of idler gears rotatably mounted in said gear box adapted in mesh with said sun gear, a pair of folding blade shafts rotatably mounted on said gear box, each of said folding blade shafts having a plurality of folding blades and a driving gear mounted thereon, said driving gears being adapted to mesh with said idler gears and one of said driving gears being adapted to move in axial direction out of engagement of said idler gear, manually-operated means for interrupting the drive to one of said folding blade shafts for silencing the folding blades associated therewith comprising a manipulating ring rotatably mounted on said gear box having a screw threaded portion formed on an inside surface thereof for engaging in a screw threaded portion formed on an end of one of said driving gears, one end of said one of the folding blade shafts being inserted into said manipulating ring and having an axial hole formed therein, a manipulating disc fixedly secured to said manipulating ring, said manipulating disc having a hole formed therein, an engaging member disposed in the hole of said manipulating disc for selectively engaging or disengaging said one of the folding blade shafts with or from said manipulating disc, and spring means disposed in the axial hole of said one of the folding blade shafts for urging said engaging member toward said manipulating disc so as to engage said folding blade shaft with said manipulating disc, and interlock means fixedly mounted on said gear box for locking said one of folding blade shafts against rotation when said one of driving gears is moved in axial direction out of engagement of one of said idler gears to engage with said interlock means.

* * * * *